US007784506B2

(12) United States Patent
Janzen

(10) Patent No.: US 7,784,506 B2
(45) Date of Patent: Aug. 31, 2010

(54) ROUGH HEW PLANER

(76) Inventor: Martin Janzen, P.O. Box 222, Horsefly, British Columbia (CA) V0L 1L0

( * ) Notice: Subject to any disclaimer, the term of this patent is extended or adjusted under 35 U.S.C. 154(b) by 475 days.

(21) Appl. No.: 11/802,465

(22) Filed: May 23, 2007

(65) Prior Publication Data

US 2008/0289723 A1 Nov. 27, 2008

(51) Int. Cl.
*B27L 11/00* (2006.01)

(52) U.S. Cl. ..... 144/373; 144/48.5; 144/154.5; 30/391

(58) Field of Classification Search ..... 144/48.5, 144/136.95, 154.5; 30/475, 476, 273, 373–377; 451/523, 524, 358, 359
See application file for complete search history.

(56) References Cited

U.S. PATENT DOCUMENTS 3,353,574 A 11/1967 Kvalheim et al.
3,495,638 A 2/1970 Humphrey
3,640,031 A * 2/1972 Descant ..... 451/522
3,703,198 A 11/1972 Luebs et al.
3,756,295 A 9/1973 Halop
3,957,095 A 5/1976 Johnson
4,137,670 A * 2/1979 Goralski ..... 451/524
4,178,663 A * 12/1979 Hayes ..... 407/29.15
4,463,786 A 8/1984 Mellott
4,519,429 A 5/1985 Dreese
4,949,768 A 8/1990 Giles et al.
5,829,145 A * 11/1998 Hughes ..... 30/475

* cited by examiner

*Primary Examiner*—Shelley Self
(74) *Attorney, Agent, or Firm*—Anthony C. Edwards

(57) ABSTRACT

Disclosed is a method and apparatus finishing the surface of a wood piece to appear rough hewn. The apparatus comprises a hand planer having a longitudinal direction, a rotatable cutter head having at least one planning blade and a bottom surface. The bottom surface has a convex curved profile longitudinally along the hand planer. The cutter head extends below the curved profile of the bottom surface. The method comprises simultaneously translating and rocking the hand planer on the bottom surface so as to intermittently engage the cutter head against a surface so as to form a plurality of spaced apart divots therein.

8 Claims, 7 Drawing Sheets

ROUGH HEW PLANER

FIELD OF THE INVENTION

This invention relates to the field of devices and methods for finishing of logs in general and in particular to a method and apparatus for surface finishing a log to appear rough hewn.

BACKGROUND OF THE INVENTION

Log homes are well known and have remained popular over the years. The use of logs for constructing homes and other buildings requires that the bark and branches be removed. Advances in log processing has allowed raw logs to be processed more quickly than previously and with less man power than by using previous hand processing methods. Many of these now conventional techniques, such as milling, for example, not only remove the bark and branches but also render the resulting log substantially uniform in shape. While more efficient, such techniques also are less desirable to some purchasers who prefer the look of logs prepared using traditional methods such as hewing or utilizing an adz which results in a plurality of random hew or adz marks distributed across and along the log.

Previous attempts to preserve the look of a rough hewn log have not been satisfactory. For example, U.S. Pat. No. 3,957,095 issued May 18, 1976 to Johnson discloses a rough hewn bench plane attachment comprising an eccentric roller attachment under one end of a hand plane such that the plane is caused to move in an eccentric manner with respect to the work piece so that a cutting iron gouges the work piece. Such an attachment will produce regularly spaced apart marks which do not accurately replicate the desired random appearance of hew marks.

In addition, U.S. Pat. Nos. 4,949,768 issued Aug. 21, 1990 to Giles et al., 3,756,295 issued Sep. 4, 1973 to Halop, 3,495,638 issued Feb. 17, 1970 to Humphrey, 3,703,198 to Lubes et al. and 3,353,574 issued Nov. 21, 1967 to Kvalheim et al. all disclose machines which impart a plurality of hew marks to a work piece fed through the machine wherein the marks are then cut by at least one rotary member within the machine. Again, the hew marks resulting from these machines will be regularly spaced apart as well as having a regular depth and length. Work pieces resulting from these devices will not therefore have a satisfactory hand hewn appearance.

What is desirable is an apparatus and method for surface treating a work piece of wood to appear rough or hand finished with a hew wherein the hew marks or divots are irregular in spacing and appearance. Such a method and apparatus would also be desirably useful for surface treating lots as well as board, timbers and other types of wood products as well.

SUMMARY OF THE INVENTION

What is disclosed is a method and apparatus for finishing the surface of a wood piece so as to appear rough or hand hewn.

According to a first embodiment of the present invention there is disclosed a hand planer for finishing the surface of a wood piece to appear rough hewn. The hand planer has a longitudinal axis and, in use, is translated in a longitudinal direction along the longitudinal axis. The planer has a bottom surface which has a convexly curved profile longitudinally along the hand planer. A rotatable cutter head having at least one planning blade extends below the curved profile of the bottom surface. Rocking the planer on the bottom surface while simultaneously translating the planer along a logs smoothly finished surface intermittently engages the cutter head against the surface of the log so as to form a plurality of spaced apart scalloped excavations in the log.

The cutter head is advantageously aligned transverse to the longitudinal axis of the hand planer. The planing blade or each planing blade if more than one may have a curved profile in a direction transverse to the longitudinal axis of the hand planer. The bottom surface may comprise a forward bottom surface ahead of the cutter head in a direction of travel of the hand planer and a rear bottom surface behind the cutter head in a direction of travel of the hand planer. The bottom surface may include a planar portion proximate to the cutter head. The hand planer may comprise at least one removable shoe mountable having the bottom surface to the hand planer.

According to a further embodiment of the present invention there is disclosed a kit for adapting a planer for finishing the surface of a wood piece to appear rough hewn. The kit comprises a rotatable cutter head rotatably receivable within the hand planer, and a bottom shoe securable to a bottom of said hand planer. The bottom shoe has a length and a bottom surface having a convex curved profile longitudinally along the shoe and a transverse opening in the bottom surface through which the cutter head may be protruded.

At least one planning blade may have a curved profile in a direction transverse to the length of the hand planer.

The bottom shoe may comprise a front shoe having a front surface locatable ahead of the cutter head in a direction of travel of the hand planer and a rear shoe having a rear surface locatable behind the cutter head in a direction of travel of the hand planer. The rear surface may include a planar portion located proximate to the cutter head when the rear shoe may be secured to the hand planer.

According to a further embodiment of the present invention there is disclosed a method of finishing the surface of a wood piece to appear rough hewn. The method comprises providing a hand planer having a rotatable cutter head having at least one planning blade and a convex curved bottom surface. The cutter head extends below the bottom surface. The method further comprises simultaneously translating and rocking the hand planar on the bottom surface so as to intermittently engage the cutter head against the surface of the wood piece so as to form a plurality of spaced apart divots therein.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION OF EMBODIMENTS OF THE INVENTION

Figure 1:
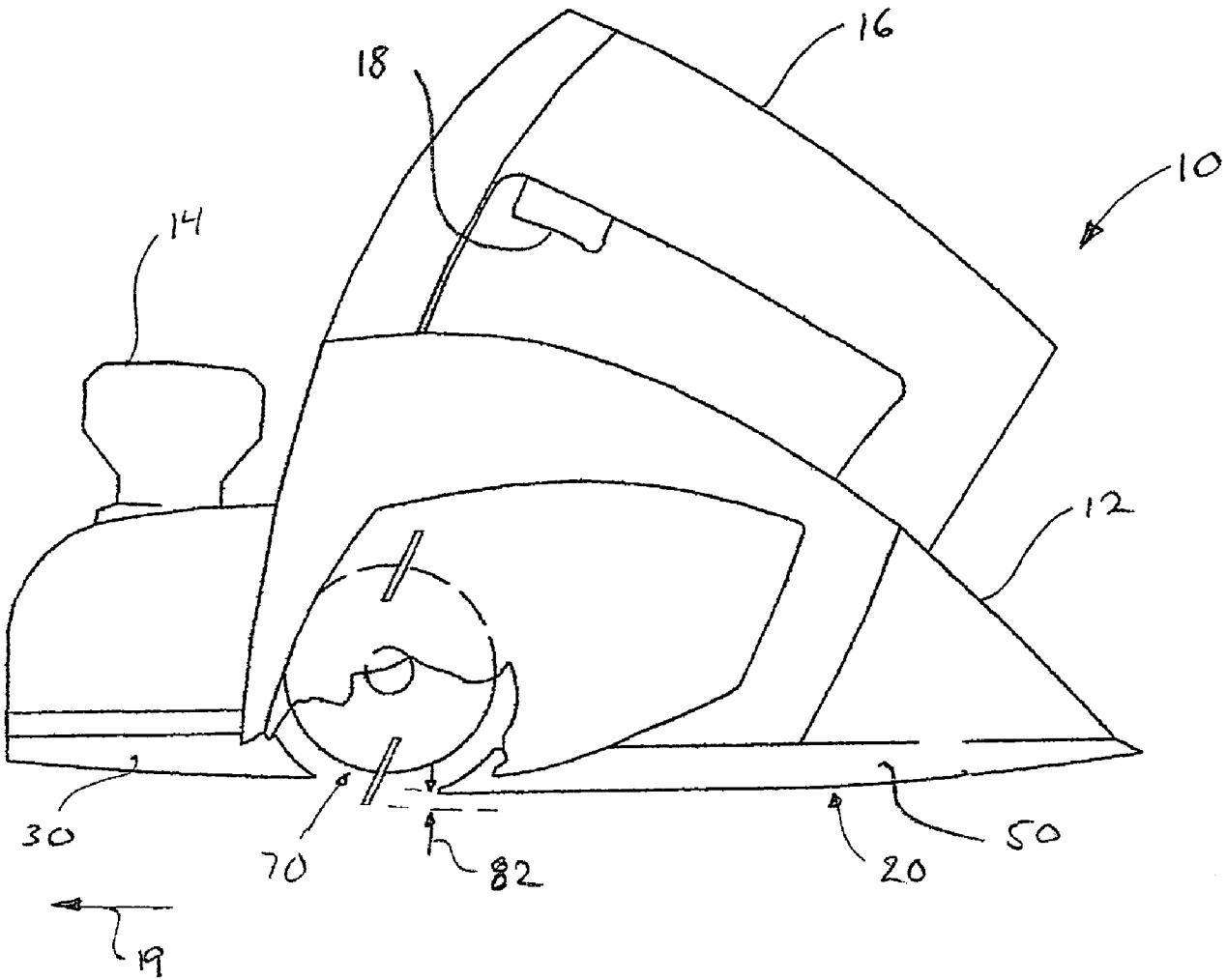
FIG. 1 is a side view of a hand planner according to a first embodiment of the present invention.
Figure 2:
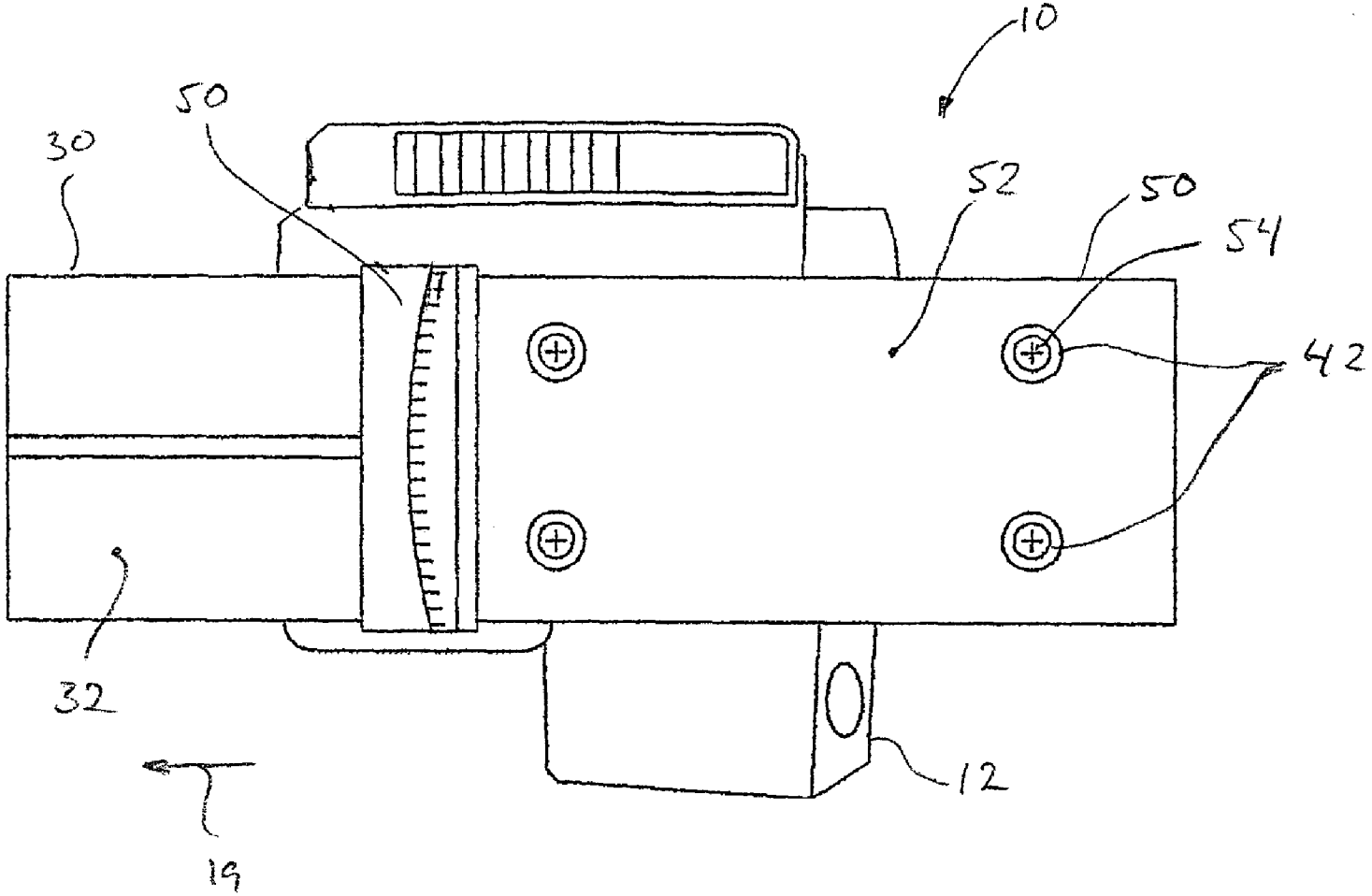
FIG. 2 is a bottom view of the hand planer of FIG. 1.

Referring to FIG. 1, an apparatus according to a first embodiment of the invention is shown generally at 10. The apparatus comprises a hand planer 12 having a curved bottom 20 and a rotatable transverse cutter rotor 70 therein. The hand planer 12 is of a conventional type and includes an electric motor (not shown) and first and second handles 14 and 16, respectively. The second handle includes a power button or trigger 18 for energizing the motor so as to rotate the cutter rotor 70. The hand planer 12 is translatable in a forward direction indicated generally at 19 so as to finish the surface of a wood workpiece.

The hand planer 12 includes a front bottom shoe 30 and a rear bottom shoe 50 attached to the bottom thereof. The front and rear bottom shoes 30 and 50 may be formed integrally with the hand planer 12 or may optionally be securable to the bottom of the hand planer 12 by means of screws 54 or other suitable fasteners as are known in the art. It will be appreciated that other methods of fastening the front and rear bottom shoes 30 and 50 may also be utilized. The bottom shoe 30 is located forward of the cutter rotor 70 in the direction of travel 19 of the hand planer and includes a forward bottom surface 32. The rear bottom shoe 50 is located behind the cutter rotor 70 in the direction of travel 19 of the hand planer 12 and includes rear bottom surface 52.

Figure 3:
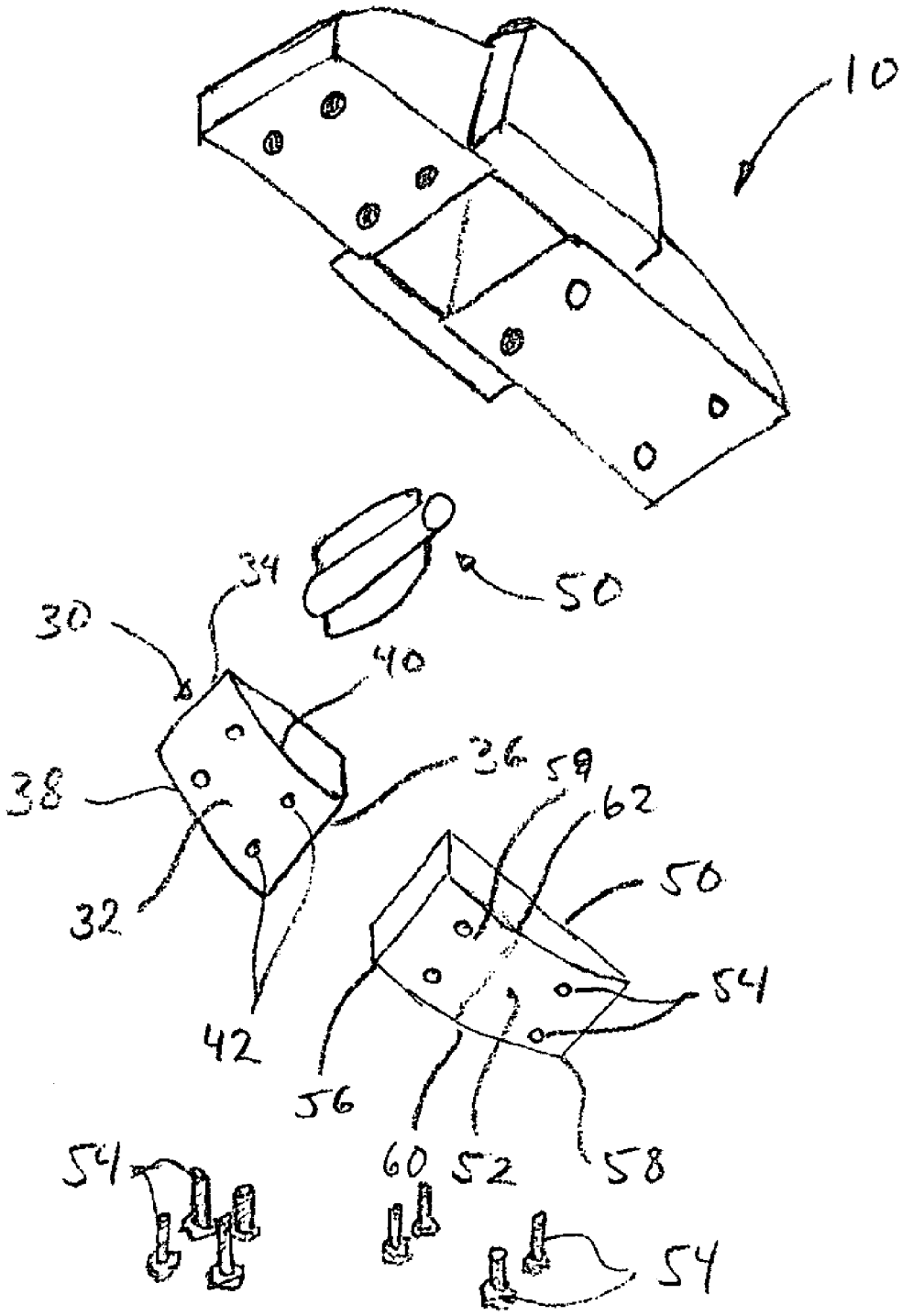
FIG. 3 is an exploded perspective view of the hand planer of FIG. 1.
Figure 7:
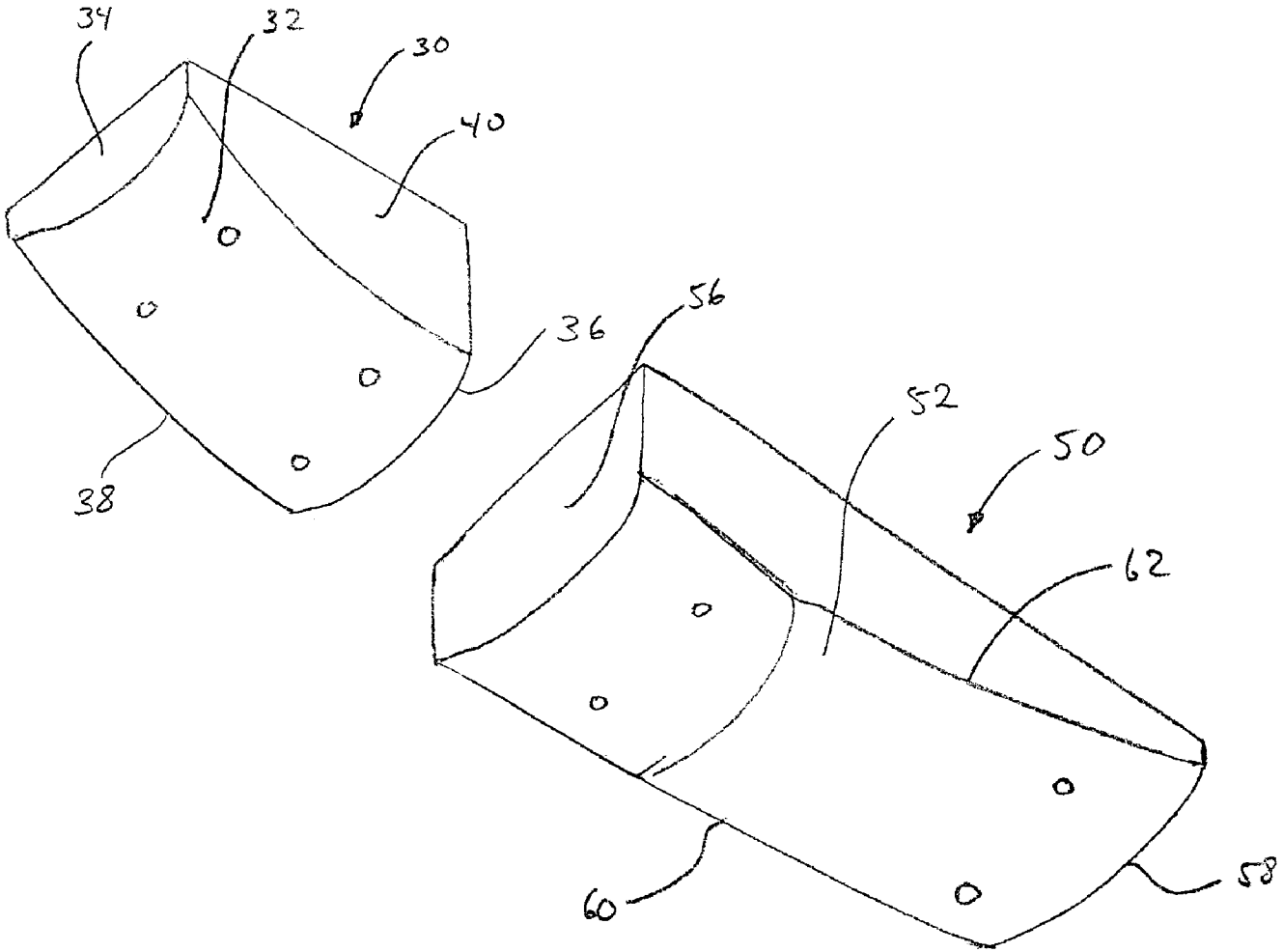
FIG. 7 is a perspective view of front and rear bottom shoes according to an alternative embodiment of the present invention.

Turning to FIG. 3, the front bottom shoe 30 comprises a substantially rectangular body having leading and trailing edges 34 and 36, respectively and first and second side edges 38 and 40, respectively. Forward bottom surface 32 is disposed between the leading and trailing edge 34 and 36 and may include a plurality of bores 42 for passing screws 54 therethrough so as to secure the forward bottom shoe 30 to the hand planer 12. As illustrated, forward bottom surface 32 is convexly curved between the leading and trailing edges 34 and 36 of the front bottom shoe. The forward bottom surface 32 may be curved at a constant curve or may have a curvature that is greater proximate to the leading or trailing edge 34 or 36. In an alternative embodiment, the forward bottom surface 32 may also be convexly curved between the first and second side edges 38 and 40 as illustrated in FIG. 7. By way of not-limiting example, the curvature of the bottom surface 20 may be such that the difference in the thickness between the leading and trailing edges 34 and 36 of the front bottom shoe 30 is between ⅛ and 3⁄16 of an inch wherein the forward bottom surface is substantially horizontal proximate to the trailing edge although it will be appreciated that other curvatures will be useful as well.

The rear bottom shoe 50 comprises a substantially rectangular body having leading and trailing edges 56 and 58, respectively and first and second side edges 60 and 62, respectively. Rear bottom surface 52 is disposed between the leading and trailing edge 56 and 58 and may include a plurality of bores 42 for passing screws 54 therethrough so as to secure the rear bottom shoe 50 to the hand planer 12. As illustrated rear bottom surface 52 is convexly curved between the leading and trailing edges 56 and 58 of the rear bottom shoe. The rear bottom surface 52 may be curved at a constant curve or may have a curvature that is greater proximate to the leading or trailing edge 56 or 58. Optionally, the rear bottom surface 52 may include a planar portion 59 proximate to the leading trailing edge 56. In an alternative embodiment, the rear bottom surface 52 may also be convexly curved between the first and second side edges 60 and 62 as illustrated in FIG. 7. By way of non-limiting example, the curvature of the bottom surface 20 may be such that the difference in the thickness between the leading and trailing edges 58 and 58 of the front bottom shoe 50 is between ⅛ and 3⁄16 of an inch wherein the rear bottom surface is substantially horizontal proximate to the trailing edge although it will be appreciated that other curvatures will be useful as well.

Figure 4:
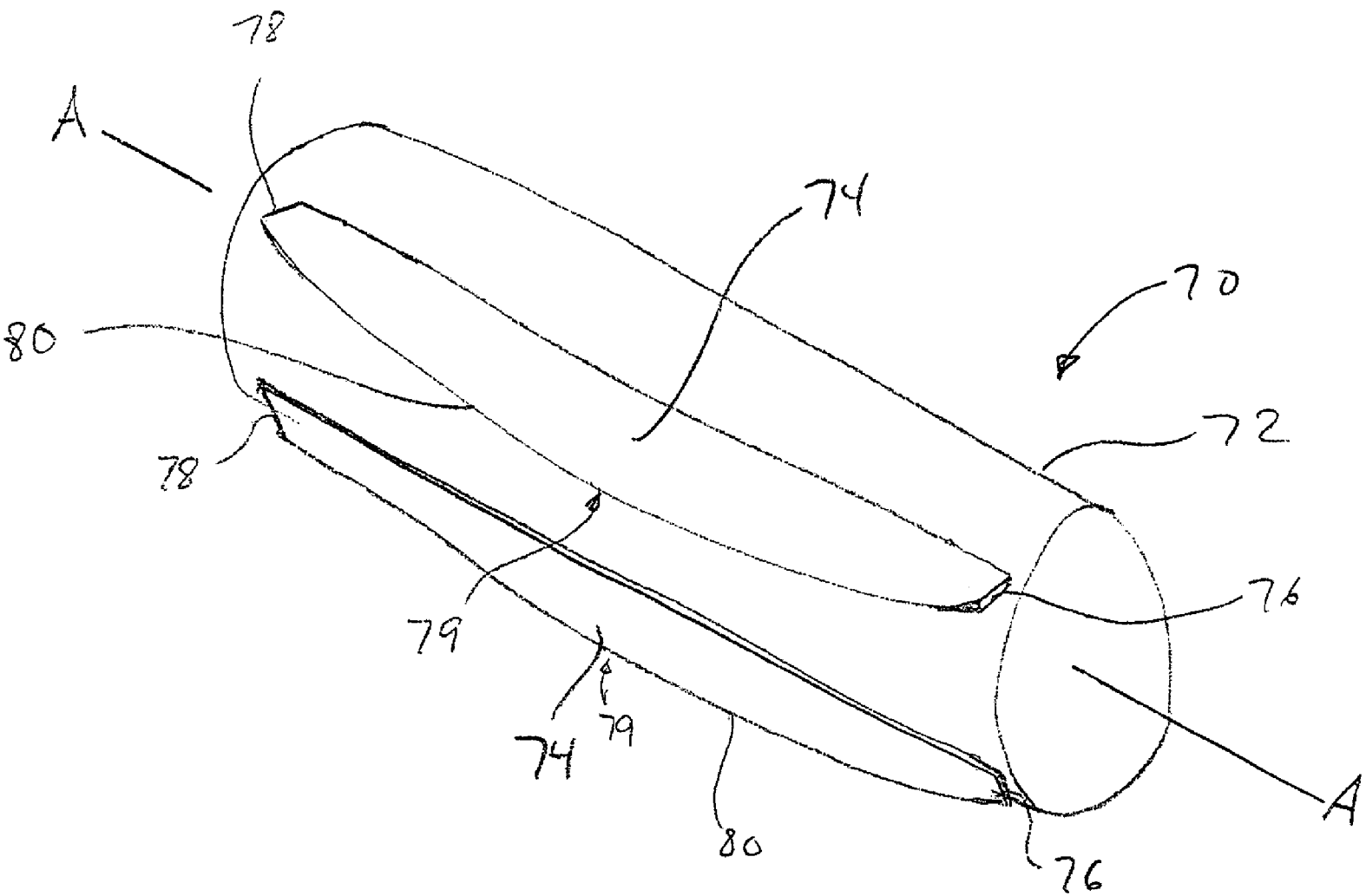
FIG. 4 is a perspective view of the chipping rotor of FIG. 1.

Turning now to FIG. 4, a perspective view of the cutter rotor 70 is shown. The cutter may be of a conventional type as are know in the art having a substantially cylindrical rotor body 72 and a plurality of cutter blades 74 extending therefrom. The cutter blades 74 extend substantially radially from the rotor body 72 although it will be appreciated that other orientations of the cutter blades relative to the rotor body will also be useful such as at an angle angularly offset from an angle extending exactly radially from the axis A of rotor body 72. The cutter blades 74 comprise an elongate planar member having first and second ends 76 and 78, respectively, and a cutting edge 80 extending therebetween. The cutting edge 80 as illustrated in FIG. 4 may be convex between the first and second ends 76 and 78. The curvature of the cutter edge 80 may be constant between the first and second ends 76 and 78 although it will be appreciated that variable curvature edges may also be useful. By way of non-limiting example, the curvature of the cutting edge 80 may be such that the edge has a height difference between the ends 76 and 78 and the center portion 79 of between ⅛ and 3⁄16 of an inch although it will be appreciated that other curvatures will be useful as well.

Referring back to FIG. 1, when installed in a hand planer 12, the cutting edges 80 of the cutter rotor 70 protrudes from the hand planer 12 past the front and rear bottom surfaces 32 and 52, by a distance generally indicated at 82. By way of non-limiting example, the cutting edges 80 of the cutter rotor 70 may protrude from the front and rear bottom surfaces by a distance of between 1⁄16 and 3⁄16 of an inch although it will be appreciated that other distances may be useful as well.

Operation

Figure 5:
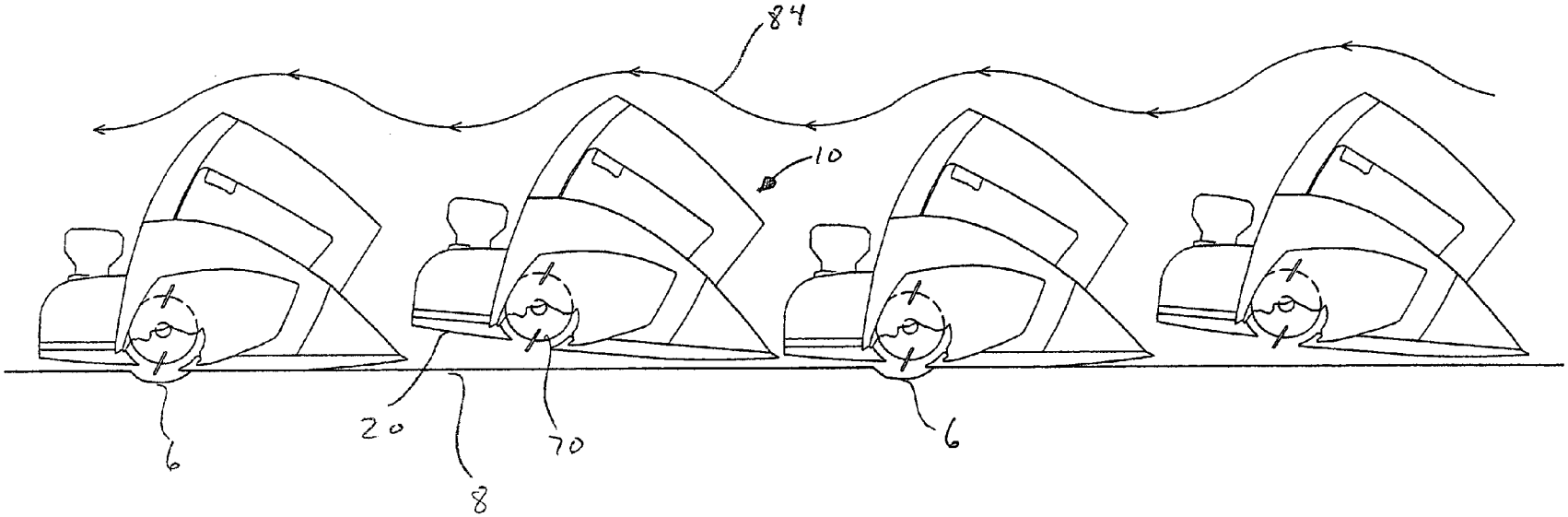
FIG. 5 is a side view of the hand planer of FIG. 1 at a plurality of positions in operation on a board.

In operation a user grasps the hand planer 12 having a curved bottom surface 20 and protruding cutter rotor 70 as described above. With the power button 18 depressed so as to rotate the cutter rotor 70, the user may place the bottom surface 20 against a wood surface to be finished. The user may then simultaneously translate the planer in a foreword direction 19 while rocking the planer in a vertical plane containing the direction of travel 19 along the curved bottom surface 20, for example in the sequence illustrated in FIG. 5. The hand planer will therefore be moved along the surface 8 of the workpiece 7 along a cyclical for example sinusoidal path indicated generally at 84. As the planer is moved past a middle portion of the rocking motion, that is as the planer is rocked between being tipped forward and tilted backward in the vertical plane, the cutter rotor 70 is selectively brought into contact with the surface 8 thereby cutting scallops, divots or otherwise concave excavations 6 into the workpiece surface. The excavation thus formed, and especially if repeated in a random pattern over the workpiece surface, cause the surface to appear rough hewn. Thus, although the sequential motion is shown as a regular sinusoid, the rough hewn effect is better accomplished by a random cycling of the rocking motion while translating.

Figure 6:
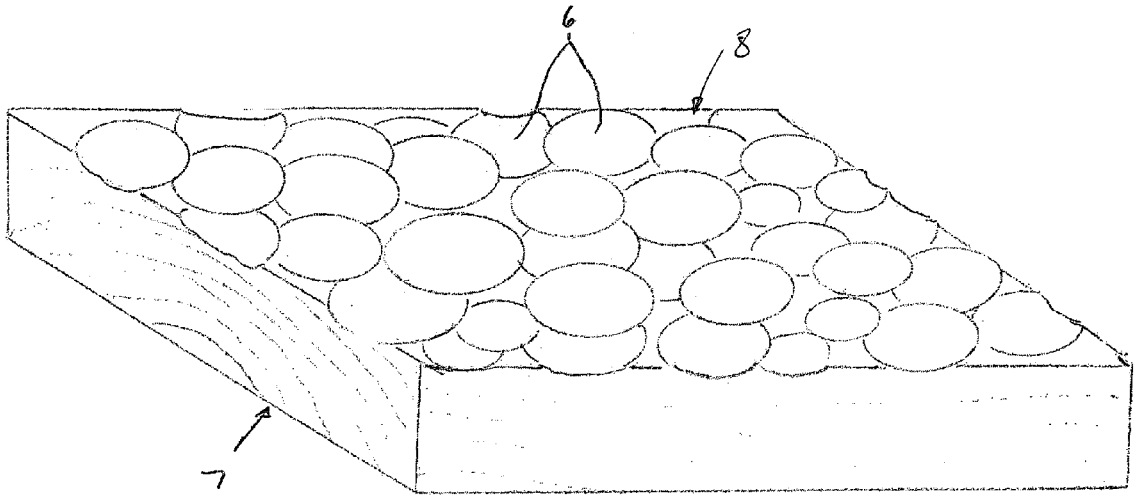
FIG. 6 is a perspective view of a surface finished by the hand planer of FIG. 1.

Thus, workpiece 7 may be finished by the use of planer 12 so that, as illustrated in FIG. 6, the workpiece has a plurality of randomly located divots 6 in the outer surface. It will be appreciated that by varying the translational speed of the planer relative to the rocking rate, divots of varying length and spacing may be formed. In addition, it will be appreciated that by performing only a partial rocking motion the cutter head may caused to form shallower divots in the surface.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A planer comprising:

a housing having a front end and an opposite rear end, opposite said front end, a handle affixed atop said housing, a lower-most surface extending from said front end to said rear end, said lower-most surface having an oppositely disposed, laterally spaced apart pair of side edges, wherein said housing includes a cutter-blade cavity formed therein, said cutter-blade cavity having an opening in said lower-most surface, and wherein said lower-most surface is formed as a rocker surface which is convex in a convex curvature extending substantially continuously from said front end to said rear end, a substantially cylindrical rotary cutter rotatably mounted transversely in said cavity wherein said rotary cutter is rotatable about an axis rotation extending longitudinally and centrodially along the length of said rotary cutter, said axis of rotation of said rotary cutter and said opening extending laterally across said cavity substantially from one side edge of said pair of side edges to the other side edges of said pair of side edges, and wherein said opening is positioned substantially medially along said rocker surface substantially medially between said front and rear ends, and wherein said rocker surface extends away from said opening to said front and rear ends sufficiently so that said housing is rockable on said rocker surface to elevate said opening above said front or rear ends, a motor mounted in said housing and operatively connected to said rotary cutter for selectively driving rotation of said rotary cutter about said axis of rotation, said rotary cutter having cutting blades mounted thereon which extend along said length of said rotary cutter and which are formed to cut a substantially cylindrical profile, said blades arranged to extend substantially radially from said rotary cutter, so as to radially extend relative to said axis of rotation, said axis of rotation and said rotary cutter positioned in said cavity so as to dispose a lower-most edge of said rotary cutter in said opening and so as to extend radially outermost edges of said blades through said opening and beneath said lower-most surface of said housing when said blades are rotated to a lower-most position, whereby said blades cut said profile in a surface-to-be-cut on which said lower-most surface of said housing is placed and when opening is aligned downwards onto the surface-to-be-cut.

2. The hand-planer of claim 1 wherein said blades each have a curved profile along the length of said each blade so that said radially outer-most edge of said each blade is convex.

3. The planer of claim 1 wherein said lower-most surface includes a planar portion proximate to said opening.

4. The planer of claim 1 wherein said housing includes a removable shoe mountable so as to form an underside thereof, and wherein said lower-most surface is on said shoe.

5. A kit for adapting a hand planer for finishing the surface of a wood piece to appear rough hewn, wherein the planer includes a housing having a front end and an opposite rear end, opposite said front end, a handle affixed atop said housing, a lower-most surface extending from said front end to said rear end, said lower-most surface having an oppositely disposed, laterally spaced apart pair of side edges, wherein said housing includes a cutter-blade cavity formed therein, said cutter-blade cavity having an opening in said lower-most surface, a substantially cylindrical rotary cutter rotatably mounted transversely in said cavity wherein said rotary cutter is rotatable about an axis rotation extending longitudinally and centrodially along the length of said rotary cutter, said axis of rotation of said rotary cutter and said opening extending laterally across said cavity substantially from one side edge of said pair of side edges to the other side edges of said pair of side edges, and wherein said opening is positioned substantially medially along said lower-most surface substantially medially between said front and rear ends, and wherein a rocker surface extends away from said opening to said front and rear ends sufficiently so that said housing is rockable on said rocker surface to elevate said opening above said front or rear ends, a motor mounted in said housing and operatively connected to said rotary cutter for selectively driving rotation of said rotary cutter about said axis of rotation, said rotary cutter having cutting blades mounted thereon which extend along said length of said rotary cutter and which are formed to cut a substantially cylindrical profile, said blades arranged to extend substantially radially from said rotary cutter, so as to radially extend relative to said axis of rotation, said axis of rotation and said rotary cutter positioned in said cavity so as to dispose a lower-most edge of said rotary cutter in said opening and so as to extend radially outermost edges of said blades through said opening and beneath said lower-most surface of said housing when said blades are rotated to a lower-most position, whereby said blades cut said profile in a surface-to-be-cut on which said lower-most surface of said housing is placed and when said opening is aligned downwards onto the surface-to-be-cut the kit comprising:

a shoe securable to said lower-most surface of said housing, said shoe having a bottom surface and wherein said bottom surface is sufficiently long and is formed as said rocker surface which is convex in a convex curvature so as to extend said convex curvature substantially continuously from said front end to said rear end of said housing when said shoe is mounted thereon, and wherein shoe has a transverse opening which is aligned with said opening in said lower-most surface of said housing when said shoe is mounted thereon; and wherein said blades extend through said transverse opening when in said lower-most position.

6. The kit of claim 5 further comprising curved-profile blades for said rotary cutter wherein said curved profile blades have a convex profile along their said radially outermost edges when mounted on said rotary cutter.

7. The kit of claim 5 wherein said bottom surface of said shoe includes a planar portion located proximate to said transverse opening when said shoe is secured to said housing.

8. A method of finishing the surface of a wood piece to appear rough hewn, the method comprising:

providing a housing having a front end and an opposite rear end, opposite said front end, a handle affixed atop said housing, a lower-most surface extending from said front end to said rear end, said lower-most surface having an oppositely disposed, laterally spaced apart pair of side edges, wherein said housing includes a cutter-blade cavity formed therein, said cutter-blade cavity having an opening in said lower-most surface, and wherein said lower-most surface is formed as a rocker surface which is convex in a convex curvature extending substantially continuously from said front end to said rear end, providing a substantially cylindrical rotary cutter rotatably mounted transversely in said cavity wherein said rotary cutter is rotatable about an axis rotation extending longitudinally and centrodially along the length of said rotary cutter, said axis of rotation of said rotary cutter and said opening extending laterally across said cavity substantially from one side edge of said pair of side edges to the other side edges of said pair of side edges, and wherein said opening is positioned substantially medially along said rocker surface substantially medially between said front and rear ends, and wherein said rocker surface extends away from said opening to said front and rear ends sufficiently so that said housing is rockable on said rocker surface to elevate said opening above said front or rear ends, providing a motor mounted in said housing and operatively connected to said rotary cutter for selectively driving rotation of said rotary cutter about said axis of rotation, wherein said rotary cutter has cutting blades mounted thereon which extend along said length of said rotary cutter and which are formed to cut a substantially cylindrical profile, said blades arranged to extend substantially radially from said rotary cutter, so as to radially extend relative to said axis of rotation, and wherein said axis of rotation and said rotary cutter positioned in said cavity so as to dispose a lower-most edge of said rotary cutter in said opening and so as to extend radially outer-most edges of said blades through said opening and beneath said lower-most surface of said housing when said blades are rotated to a lower-most position, whereby said blades are adapted to cut said profile in a surface-to-be-cut on which said lower-most surface of said housing is placed and when opening is aligned downwards onto the surface-to-be-cut, simultaneously translating and rocking against a surface-to-be cut said housing on said rocker surface and randomly intermittently engaging said blades of said cutter head against the surface-to-be cut so as to cut said profile as a plurality of randomly spaced apart divots in said surface-to-be cut.

* * * * *